United States Patent [19]

Weirich et al.

[11] 4,099,782

[45] Jul. 11, 1978

[54] CONTROL SYSTEM FOR A MINERAL MINING INSTALLATION

[75] Inventors: Walter Weirich, Dortmund; Heinrich Wildförster, Gelsenkirchen-Buer, both of Fed. Rep. of Germany

[73] Assignee: Gewerkschaft Eisenhutte Westfalia, Lunen, Fed. Rep. of Germany

[21] Appl. No.: 769,367

[22] Filed: Feb. 16, 1977

[30] Foreign Application Priority Data

Feb. 18, 1976 [DE] Fed. Rep. of Germany ..... 2606394
May 22, 1976 [DE] Fed. Rep. of Germany ..... 2623016

[51] Int. Cl.[2] ..... E21D 15/48
[52] U.S. Cl. ..... 299/1; 299/43
[58] Field of Search ..... 299/43, 1, 1 UPD; 173/19

[56] References Cited

U.S. PATENT DOCUMENTS 3,482,877 12/1969 Jacobi ..... 299/1

FOREIGN PATENT DOCUMENTS 1,242,537 6/1967 Fed. Rep. of Germany ..... 299/1

*Primary Examiner*—Ernest R. Purser
*Assistant Examiner*—William F. Pate, III
*Attorney, Agent, or Firm*—Sughrue, Rothwell, Mion, Zinn and Macpeak

[57] ABSTRACT

A system for controlling the thrust applied to a mineral winning machine, which is movable along a guide at a longwall face in a mine working, includes control means which regulates the thrust applied to the guide by hydraulic rams in dependence upon the loading of the winning machine drive. The control means may include one pressure regulator for each ram, one pressure regulator for each of a plurality of groups of rams, or one pressure regulator for all the rams.

33 Claims, 3 Drawing Figures

CONTROL SYSTEM FOR A MINERAL MINING INSTALLATION

BACKGROUND OF THE INVENTION

This invention relates to a control system for a mineral mining installation, and to a mineral mining installation employing such a system.

In mineral mining installations employing a mineral winning machine movable along a guide, it is known to provide a control system for operating shifting rams to cause the guide, and hence the winning machine, to be advanced towards the mineral face. The guide is either formed on one side of a lonwall scraper-chain conveyor or is a separate guideway associated with the conveyor. The guide is usually composed of sections and it is conventional to cause the guide sections to be advanced successively and incrementally by the full cutting depth of the machine after passage of the machine. Each guide section is provided with a shifting ram, and the shifting rams abut against the units of a walking frame roof support assembly. The shifting rams are, therefore, used for advancing the guide, the conveyor and the winning machine after the winning machine has cut away the mineral face to its full depth, as well as for applying a regulated thrust to the guide, and hence to the winning machine, during the winning process. This regulated thrust is controlled, in the known control system, by control valves provided in the hydraulic distribution system leading to the rams and extending along the longwall conveyor. The hydraulic distribution system also supplies other devices such as the props of the roof support assembly.

The shifting rams are also used for drawing up the units of the roof support assembly after the guide, conveyor and winning machine have been advanced. Since higher pressures are needed for this advancement of the roof support assembly, the pressure applied by the winning machine, via the guide and the shifting rams, is often unnecessarily high. These excessive pressures are sometimes even harmful, because the power consumption of the drive for the winning machine is substantially increased. Where, as is usual, the winning machine is chain driven, the excessive thrust may, even during normal operations, cause snapping of the safety shear pins which serve to limit the tension in the chains. Moreover, unnecessarily high thrust applied to the winning machine results in excessive wear to its cutters and sometimes to jamming of the machine.

These difficulties are particularly prevalent where the winning machine is a plough which is movable along a guide formed on the conveyor and which is driven, via a sword plate extending under the conveyor, by an endless chain provided on the goaf side of the conveyor. This is because the reaction forces of the plough act to force the conveyor away from the face so as to cause high pressure in the rams which thus consume a high proportion of the overall power consumption. Moreover, in order to prevent jamming of the plough, it is necessary to use heavy duty machinery and thick driving chain for the plough.

SUMMARY OF THE INVENTION

The present invention provides a system for controlling the thrust applied to a mining winning machine which is movable along a guide at a longwall face in a mine working, the system including control means which regulates the thrust applied to the guide by hydraulic rams in dependence upon the loading of the winning machine drive.

Preferably, the control means is constituted by a transducer for detecting the loading of the winning machine drive and for emitting appropriate control signals, and a respective pressure regulator associated with each of the rams for regulating the thrust applied to the guide by said rams in dependence upon said control signals. Alternatively, the control means is constituted by a transducer for detecting the loading of the winning machine drive and for emitting appropriate control signals, and a respective pressure regulator associated with each of a number of groups of rams for regulating the thrust applied to the guide by the rams of each group in dependence upon said control signals.

In the case where each pressure regulator is associated with a single ram, the pressure regulators are connected to the transducer by a common electric control line and each pressure regulator is provided with switching means connected to the control line and responsive to said control signals; and, where each pressure regulator is associated with a group of rams, each pressure regulator is connected to the transducer by a respective electric control line and each pressure regulator is provided with switching means connected to the corresponding control line and responsive to said control signals. In either case each pressure regulator communicates with hydraulic pressure and return lines.

Advantageously, each pressure regulator is provided with pressure reducing valve means. Preferably, the pressure reducing valve means of each pressure regulator includes a valve which passes hydraulic fluid to the associated ram or group of rams at a first, higher pressure when the winning machine drive is turned off, and at a second, lower pressure when the winning machine drive is turned on and the winning machine is working.

Advantageously, each pressure regulator is so constructed that hydraulic fluid can be passed to the associated ram or group of rams at the full pressure of the pressure line. Preferably, when the system is to be used with double-acting rams, each pressure regulator is such that the full pressure of the pressure line can be applied to the opposite end(s) of the associated ram(s) to the end(s) at which pressure is applied to regulate the thrust in dependence upon the loading of the winning machine drive.

With this control system, it is possible to adjust the thrust of the guide (and hence that of the winning machine) against the working face, automatically to eliminate excessive pressures and so prevent jamming of the winning machine. Moreover, when the winning machine is turned off at the end of its winning travel, a relatively high thrust is applied to force the guide firmly against the face. Furthermore, the system permits the full pressure of the pressure line to be applied to the opposite ends of the rams to draw up the roof support assembly associated with the installation.

As an alternative to providing one pressure regulator for each ram or group of rams, it it possible to utilize only one pressure regulator for all the rams. In this case, the control means is constituted by a transducer for detecting the loading of the winning machine drive and for emitting appropriate control signals, and a single pressure regulator for regulating the thrust applied to the guide by all of said rams in dependence upon said control signals. Here, the pressure regulator communicates both with a pair of lines constituting hydraulic pressure and return lines and with a pair of lines constituting hydraulic supply lines to the rams.

This single pressure regulator may be constituted by a pressure reducing valve, control valve means for directing the hydraulic fluid leaving the pressure reducing valve to a first of the supply lines when in a first operating condition and to the second of the supply lines when in a second operating condition, and switching means for switching the control valve means between its two conditions. Advantageously, the pressure reducing valve is adjustable, preferably within the range of from 20 to 300 kg/cm$^2$.

Preferably, the control valve means is constituted by two pairs of interconnected, hydraulically operated, non-return valves, the hydraulic line connecting one of said pairs of non-return valves being connected to the outlet of the pressure reducing valve, and the hydraulic line connecting the other of said pairs of non-return valves being connected to the return line, and wherein one non-return valve of each pair is connected to the first supply line and the other non-return valve of each pair is connected to the second supply line. A check valve may be provided in the hydraulic line connecting the outlet of the pressure reducing valve and said one pair of non-return valves, and a check valve may be provided in the hydraulic line connecting the return line to said other of said pairs of non-return valves. Advantageously, each of the check valves is manually operable.

The switching means may be constituted by a pair of hydraulic switching valves each of which is connected both to the pressure and return lines and to a respective one of said pairs of non-return valves, each of the hydraulic switching valves being controlled by said control signals.

The control means may be further provided with a respective auxiliary control unit for each of the rams, each auxiliary control unit being connected to both supply lines and, in use, to both ends of the corresponding double-acting ram.

Advantageously, each auxiliary control unit is so constructed as to be controlled either automatically by the pressure regulator, or manually. Preferably, each auxiliary control unit has a first set of valves for automatic control and a second set of valves for manual control, the valves of both sets being cam-operated by a common valve spool, and wherein the inlets of the corresponding valves of the two sets are connected by bridging lines which incorporate non-return valves so positioned that when the valve spool is positioned for automatic control the bridging lines used during manual control are blocked and vice-versa.

The invention also provides a mining installation comprising a longwall conveyor, a winning machine movable along a guide provided on the conveyor, hydraulic shifting rams for the conveyor, and a control system for controlling the thrust applied by the rams to the conveyor, wherein the control system is as defined above.

The invention further provides a method of controlling the thrust applied to a mining winning machine which is movable along a guide at a longwall face in a mine working, the method comprising the steps of sensing the load of the winning machine drive, transmitting a control signal in dependence upon the sensed load, and controlling the thrust applied by hydraulic rams to the guide in dependence upon the control signal.

BRIEF DESCRIPTION OF THE DRAWINGS

A mineral mining installation incorporating a control system constructed in accordance with the invention will now be described, by way of example, with reference to the accompanying drawings, in which.

DESCRIPTION OF PREFERRED EMBODIMENTS

Figure 1:
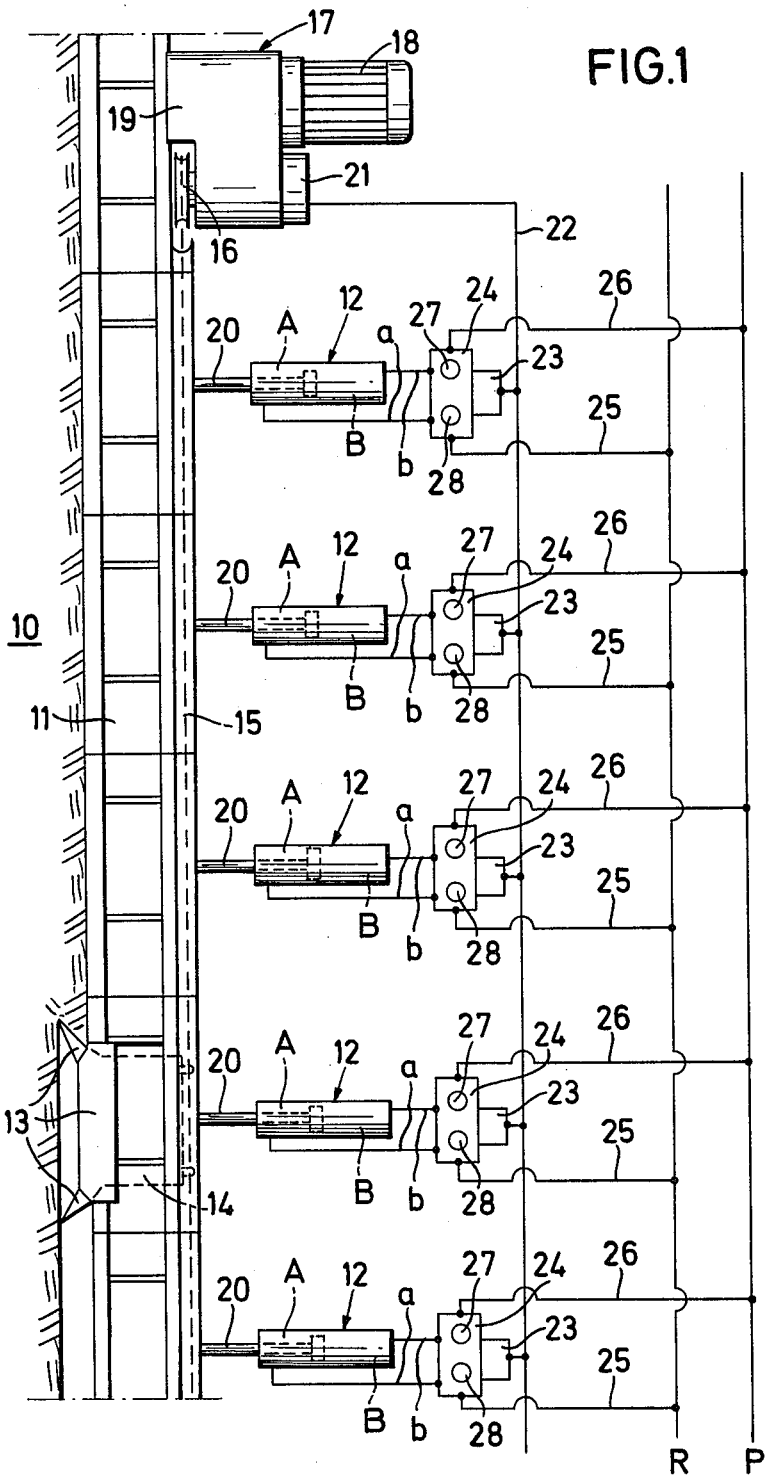
FIG. 1 is a schematic plan view of the installation.

Referring to the drawings, FIG. 1 shows the mining installation in position in front of a coal face 10 of a longwall working. A scraper-chain conveyor 11 is positioned along the face 10, the conveyor being composed, in known manner, of a series of channel sections joined end-to-end. A scraper-chain assembly (not shown) is circulated along these channel sections. The channel sections are inter-connected in such a manner as to allow a certain amount of angular mobility between adjacent sections about the central longitudinal axis of the conveyor 11. This permits the sections of the conveyor 11 to be advanced successively and incrementally by means of double-acting hydraulic shifting rams 12 which are disposed on the goaf side of the conveyor.

The conveyor 11 serves as a guide for a plough 13 which is driven along the conveyor, via a sword plate 14 which extends under the conveyor, by means of an endless chain 15. The chain 15 is accommodated on the goaf side of the conveyor 11 and passes round end sprockets 16 (only one of which is shown). At least one of the sprockets 16 is driven by a drive unit 17 which comprises a suitably-rated electric motor 18 and a gear box 19. The plough 13 and its associated drive means are well known and so require no further description.

The rams 12 are provided with piston rods 20 which engage the goaf side of the conveyor 11, the cylinders of the rams engaging the units of a walking frame roof support assembly (not shown). The rams 11 can, therefore, be used to advance the conveyor 11, and hence the plough 13, to the full cutting depth of the plough, by extending the piston rods 20. The roof support assembly can then be drawn up to the advanced conveyor 11, after their props are retracted, by applying hydraulic pressure to the other ends of the rams 12 so as to retract the piston rods 20.

The hydraulic distribution system for the rams 12 includes a pressure line P and a return line R which run the entire length of the conveyor 11. These lines P and R are connected to the various hydraulic power consumption points such as the props of the roof support-assembly, as well as to the rams 12.

The pressure of hydraulic fluid applied to the rams 12 is controlled by a control system which includes a transducer 21 which emits control signals which are transmitted along a cable 22 to pressure regulators 24 associated with the rams. The transducer 21 is accommodated in a console mounted on the drive unit 17. Alternatively, the transducer 21 could be installed elsewhere, for example in association with the switch gear in the gear box 19. The essential point here is that the transducer 21 must be mounted so as to respond to the load on the drive unit 17 and emit control signals in dependence upon that load. Each pressure regulator 24 is provided with a switch 23 connected to the cable 22. The switches 23 are preferably constituted by solenoid switching valves or relays. Each pressure regulator 24 is connected to the return line R by a line 25 and to the pressure line P by a line 26. In addition, each pressure regulator 24 is connected, at the discharge side thereof, with the cylinder spaces A and B of the corresponding ram 12 by means of lines *a* and *b*.

Each pressure regulator 24 is provided with two pressure reducing valves 27 and 28 which serve to throttle the high hydraulic pressure in the pressure line P to pressures selected for the particular operations described below. The valves 27 and 28 may be continuously adjustable valves or may utilise two or more pressure reducing valves having fixed throttling ratios. The valves 27 and 28 of each regulator 24 are provided in the line *b* leading to the cylinder space B.

The valves 27 and 28 are controlled by the transducer 21 via the cable 22 and the switches 23 in dependence upon the power consumed by the motor 18 of the drive unit 17. In its simplest form, this is done as follows:

Assuming that the plough 13 is positioned at one end of the coal face 10, and that the plough is stationary, the cylinder spaces B of the rams 12 are connected to the pressure line P via the corresponding valves 27 and lines 26. Depending on the adjustment of the valves 27, the cylinder spaces B are supplied with hydraulic fluid at a pressure which is either equal to, or somewhat less than, that of fluid in the pressure line P. At this stage, the cylinder spaces B should be subjected to a relatively high pressure so that, before the plough 13 begins its coal cutting travel, the conveyor 11 is pressed firmly against the coal face 10. Thus, it is not absolutely necessary, at this stage, to throttle the pressure prevailing in the pressure line P in the valves 27. However, as soon as the drive unit 17 is switched on and the plough 13 starts cutting coal, the transducer 21 emits a signal which is fed to the switches 23, via the cable 22, to throttle the valves 27. This results in the cylinder spaces B being supplied with hydraulic fluid at a lower pressure than that prevailing in the pressure line P. Consequently, the force with which the plough 13 is held against the coal face 10 is reduced to the required magnitude. At the end of the coal cutting travel, the drive units 17 are stopped for a short time to reverse the direction of drive to the plough 13. The valves 27 are readjusted so as to supply the full (or higher) pressure to the cylinder spaces B so that the conveyor 11 is forced into firm contact with the coal face 10, should this not have remained the case under the lower pressure conditions which prevailed during the coal cutting travel.

In this simplest form of system, the transducer 21 merely emits control signals to inform the regulators 24 whether the plough drive is on or off. In order to do this, the transducer 21 is provided with a switching device such as a simple switch mechanically linked to the ON-OFF switch of the plough drive motor 18. This switch is opened (or closed) when the plough drive is switched on (or off) so that corresponding control signals are sent by the transducer 21 to the switches 23 via the cable 22.

The system described above for controlling the thrust applied to the plough 13 during cutting may be improved by varying the thrust in dependence upon the load on the plough, that is to say upon the power consumption of the motor 18 driving the plough. Thus, the thrust on the plough 13 may be reduced in proportion with an increased load demand of the plough or current consumption of the motor 18. This is effected by varying the pressure of hydraulic fluid in the cylinder spaces B, by throttling the pressure of the fluid in the pressure line P through the valves 28, in dependence upon the power consumption of the motor 18. This pressure variation may be effected continuously or in steps, the simplest way being to reduce the pressure in the cylinder spaces B only when a predetermined load is reached, this being reflected in the current consumption of the motor 18. As soon as the load on the plough 13 drops below the predetermined level, the motor current also drops and the pressure in the cylinder spaces B is increased to the normal working pressure via the transducer 21. In this case, the transducer 21 is provided with a control element which responds to increasing motor current consumption by emitting a control signal at the current level corresponding to the predetermined load on the plough 13. Such control elements are so well known as to require no fuller explanation.

Although each of the regulators 24 described above has two valves 27 and 28, it is possible to replace these two valves by a single pressure reducing valve. In this case, the regulators 24 supply the cylinder spaces B either with the full pressure of line P (when the plough 13 is stationary at the ends of the coal face 10), or with a reduced pressure (during coal cutting).

In any case, the full pressure is applied to the cylinder spaces A, after the conveyor 11 has been advanced, for the purpose of drawing up the roof support assembly.

The rams 12, which are positioned along the entire length of the conveyor, may be arranged in groups with a common pressure regulator for each group, and each pressure regulator may be controlled by a respective control cable. In this way, the rams 12 of each group may be operated independently of the rams of other groups, so that only the rams in the region of the plough 13 are supplied with the lower operating hydraulic pressure, the rams in all other groups being supplied with the higher operating pressure. Obviously, as the plough 13 passes to the next group of rams during its coal cutting travel, the rams of this next group will then be the only ones supplied with the lower operating pressure.

Figure 2:
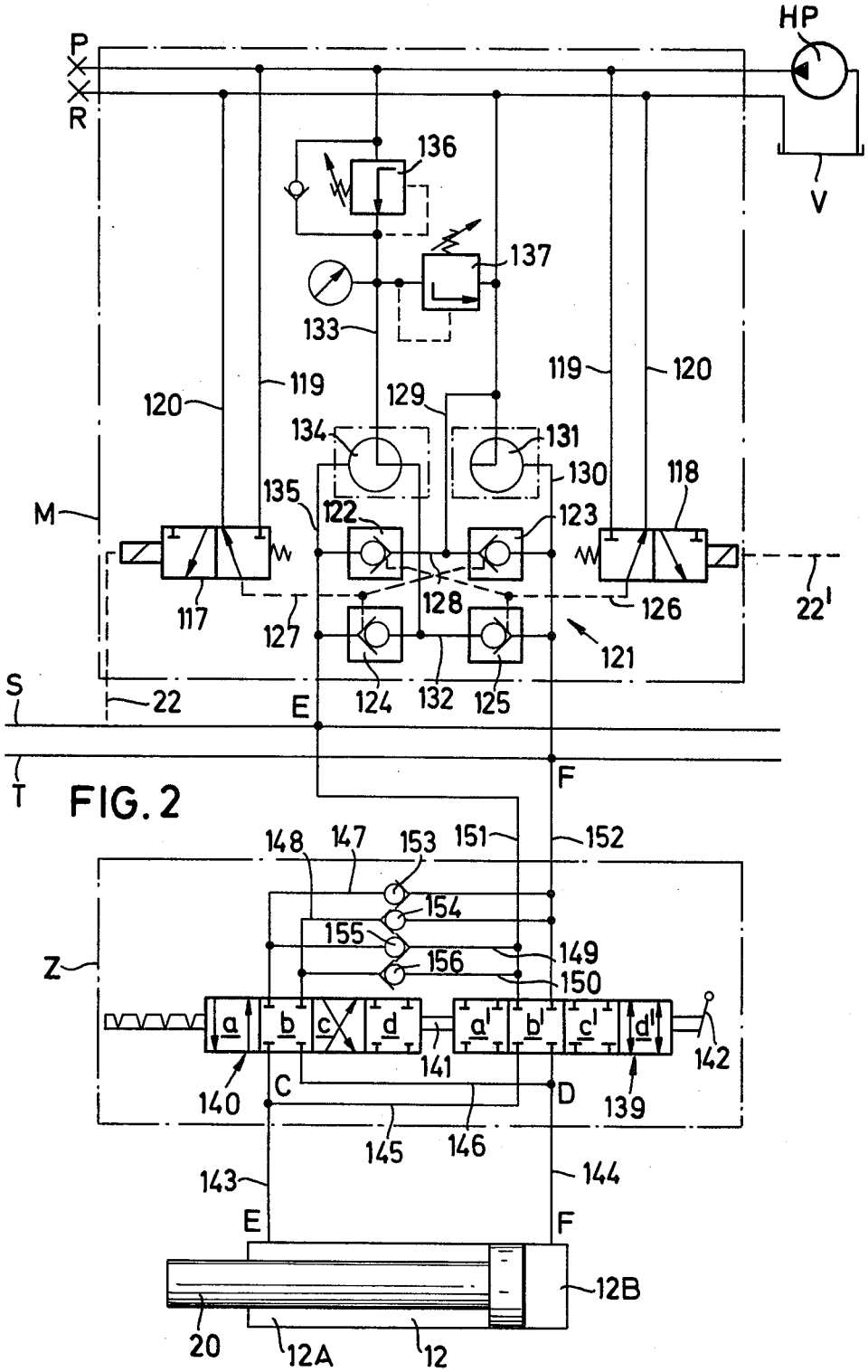
FIG. 2 is a circuit diagram of a modified form of control system for use with the installation of FIG. 1.
Figure 3:
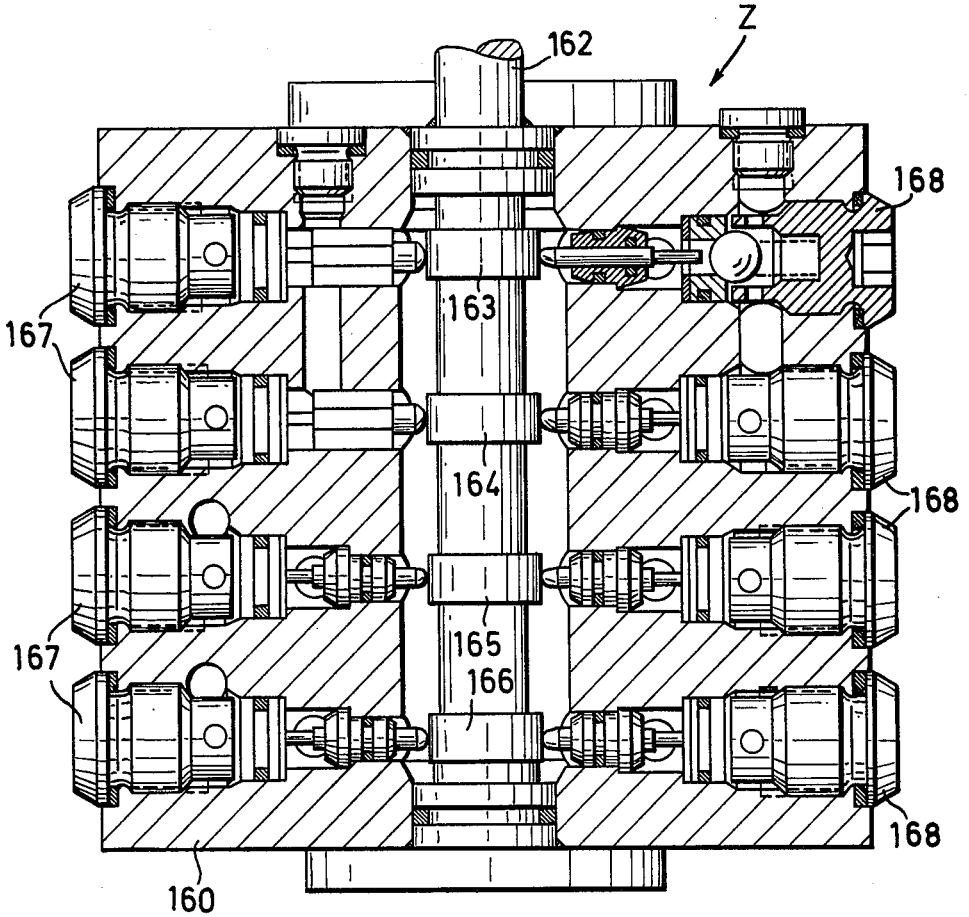
FIG. 3 is detailed view of an auxiliary control unit shown in FIG. 2.

It is also possible to provide a single pressure regulator for all the rams 12, in which case the cylinder spaces B of all the rams are connected to the output of the single common regulator. FIGS. 2 and 3 show an embodiment utilising such a single common regulator. Here, P again denotes the high pressure supply line and R the return line. HP denotes a high pressure pump for supplying the hydraulic fluid to the line P at the required high pressure. The return line R discharges into a resevoir V.

The single common pressure regulator is constituted by a main control unit M which is mounted adjacent to the plough drive unit (not shown) and connected thereto by electric control lines 22 and 22'. A transducer (not shown, but similar to the transducer 21 of FIG. 1) is also provided for transmitting information about the plough drive loading to the control unit M.

Only one ram 12 is shown in FIG. 2 but it will be understood that, in order to advance the conveyor (not shown, but similar to the conveyor 11 of FIG. 1), a plurality of rams 12 spaced therealong, are needed. As was the case with the embodiment of FIG. 1, the rams 12 abut against the units of a walking frame roof support assembly (not shown) in such a manner that the conveyor is advanced when the piston rods 20 of the rams are extended. Also, when the props of the roof support assembly are retracted, the assembly is drawn up to follow the advance of the conveyor by retracting the piston rods.

The main control console M includes a pair of solenoid valves 117, and 118, each of which is connected to the pressure and return lines P and R by means of lines 119 and 120 respectively, and a switching unit 121. The unit 121 contains four hydraulically operated non-return valves 122, 123, 124, and 125, the valves 122 and 125 being connected to the output of the valve 118 by a common control line 126, and the valves 123 and 124 being connected to the output of the valve 117 by a common control line 127. The valves 122 and 123 are interconnected by a line 128 which is connected to the return line R by a line 129. A check valve 131, such as a cock, is provided in a line 130 which interconnects the return line R and the valves 123 and 125. The two other valves 124 and 125 are interconnected by a line 132 which is connected to the pressure line P by a line 133. A check valve 134, such as a cock, is provided in the line 133 and is also connected to a line 135 which is connected to the valves 122 and 124 and which leads to a supply line S to the rams 12. The other two valves 123 and 125 are connected to a second supply line T via an extension of the line 130. The supply lines S and T extend along the entire length of the conveyor and supply all the rams 12.

A pressure reducing valve 136 is provided in the line 133 between the check valve 134 and the pressure line P. This valve 136 is adjustable within the range of from 20 to 300 kg/cm$^2$ so that the high pressure prevailing in the line P can be reduced, by valve 136, to any desired operating pressure within this range. A pressure relief valve 137 is provided between the lines 133 and 129.

Each ram 12 is connected, at E and F, to the two supply lines S and T by a respective auxiliary control unit Z. The unit Z contains a pair of spool valves 139 and 140 which are mechanically linked at 141 for joint operation by a hand lever 142. The valves 140 and 139 each have four switching positions *a, b, c, d* and *a', b', c', d'* respectively. The valve 139 is used when the associated ram is to be controlled automatically, and the valve 140 is used for manual control. The cylinder spaces 12A and 12B are each connected to the outlets C and D of the unit Z by the lines 143 and 144 respectively, the outlets being themselves interconnected by lines 145 and 146 in the manner shown. The valves 139 and 140 are connected to the supply lines S and T by input lines 151 and 152 respectively. These lines 151 and 152 are interconnected by lines 147, 148, 149 and 150. Each of the lines 147, 148, 149 and 150 is provided with a non-return valve 153, 154, 155 and 156 respectively.

The control system described above with reference to FIG. 2 operates as follows. During coal cutting operations, the valve 118 is set by the transducer via the electric control line 22' so that the control line 126 is connected to the pressure line P through the line 119. At the same time the valve 117 is set to the shown position by the transducer via the electric control line 22, so that the control line 127 is connected to the return line R through the line 120. Both the valves 122 and 125 are then supplied with hydraulic fluid under pressure from the control line 126, and open. The high pressure hydraulic fluid can, therefore, flow from the pressure line P, through the pressure reducing valve 136, and then at a suitably reduced pressure through the line 133, the check valve 134 and the valve 125 to the supply line T. The other supply line S is connected to the return line R via the line 135, the valve 122 and the line 129.

During normal operation of the plough, the unit Z is set so that the valve 139 is in position *d'* and the valve 140 is in position *d*, so that the cylinder space 12B of the ram 12 is connected to the pressurised supply line T via the line 144, the valve 139 and the line 152. Thus, the piston rod 20 of the ram is extended to thrust the conveyor and the plough towards the coal face.

When a predetermined power demand for the plough drive unit is exceeded, which happens in particular when the plough jams, the transducer sends a control signal, via the line 22, which switches over the valve 117. At the same time a control signal sent via the line 22' switches over the valve 118. When the valve 117 is switched its control line 127 is connected to the pressure line P and the valves 123 and 124 are, therefore, opened. At the same time, the control line 126 is connected to the return line R so that the valves 122 and 125 close. As a result, the supply line S is connected to the pressure line P via the line 135, the line 132, the check valve 134, the line 133 and the pressure reducing valve 136. Simultaneously, the supply line T is connected to the return line R via the line 130, the valve 123 and the line 129. Because of the change of the pressures in the supply lines S and T, the cylinder space 12A is now under pressure as it is connected to the pressurised supply line S. The piston rod 20 is, therefore, retracted to ease the conveyor away from the coal face.

When the power demand of the plough drive unit is thereby reduced under the predetermined value, the plough jam is released and the two valves 117 and 118 are again switched over by the transducer via the electric control lines 22 and 22'. Pressure is then re-applied to the cylinder space 12B so that the piston rod 20 extends and thrusts the conveyor and the plough back into firm contact with the coal face.

The auxiliary control unit Z can also be used to switch from automatic to manual control. Thus, manual control can be effected by setting the valve 139 to position *a'* and the valve 140 to position *a*. In this position, the cylinder space 12A is connected to the pressurised supply line T via the line 147, the open non-return valve 153 and the line 152. The other cylinder space 12B is connected to the other supply line S (which is connected to the return line R) via the lines 144, 146 and 148, the open non-return valve 156 and the line 151. Consequently, the piston rod 20 is retracted. When the valves 139, and 140 are set to the positions *c'* and *c* respectively, the conditions are reversed, and the piston rod 20 is extended. Thus, the valves 139 and 140 and the non-return valves 153 to 156 are so arranged that during manual operation the automatic control system is blocked and vice-versa.

FIG. 3 shows a preferred form of the unit Z, having a spool housing 160 and a spool 162 which carries cams 163, 164, 165 and 166 each of which actuates two valves. The housing 160 is provided with two pairs of four-valve groups 167 and 168 which correspond to the four switching positions of the two valves 139 and 140 of the FIG. 2 embodiment. Each of the valves 167, and 168 is a tappet-operated, non-return ball valve. The valves of the two groups are bridged by lines (not shown) provided with non-return valves (not shown, but similar to the valves 153, 154, 155 and 156). The switching sequence and function of these valves are otherwise the same as the corresponding valves of the FIG. 2 embodiment. The important point here is that this control unit is provided with a rotatable spool 162 which operates all the valves 167, 168. The spool 162 can, thus, be rotated to positions suitable for automatic control or for manually extending or retracting the piston rod 20, or into a fourth position in which both cylinder spaces 12A and 12B are hydraulically blocked.

It will be appreciated that the transducer in each of the embodiments described above need not be an electrical transducer. Thus, the transducer could be a hydraulic control valve, in which case the switches 23 of the FIG. 1 embodiment would be replaced by piston-and-cylinder devices and by pressure reducing valves. Similarly, the valves 117 and 118 of the FIG. 2 embodiment could easily be controlled hydraulically. It would also be possible, in cases where a drive unit is provided at each end of the conveyor, to provide each drive unit with a transducer. In this case, the control system may be operated by either one of the transducers or by the two together.

We claim:

1. In a control system for controlling the thrust applied, by hydraulic rams, to a driven mining winning machine via a guide along which the mining winning machine is movable, the improvement comprising control means which regulates the thrust applied to the guide by the hydraulic rams in dependence upon the loading of the winning machine drive, said control means comprising a transducer for detecting the loading of the winning machine drive and for emitting appropriate control signals, and pressure regulator means associated with the rams for regulating the thrust applied to the guide by said rams in dependence upon said control signals.

2. A control system according to claim 1, wherein a respective pressure regulator is associated with each of the rams.

3. A control system according to claim 2, wherein the pressure regulators are connected to the transducer by a common electric control line and each pressure regulator is provided with switching means connected to the control line and responsive to said control signals.

4. A control system according to claim 2, wherein each pressure regulator communicates with hydraulic pressure and return lines.

5. A control system according to claim 2, wherein each pressure regulator is provided with pressure reducing valve means.

6. A control system according to claim 5, wherein the pressure reducing valve means of each pressure regulator includes a valve which passes hydraulic fluid to the associated ram at a first, higher pressure when the winning machine drive is turned off, and at a second, lower pressure when the winning machine drive is turned on and the winning machine is working.

7. A control system according to claim 6, wherein the pressure reducing valve means of each pressure regulator further includes a second valve which is operative, upon the loading of the winning machine drive exceeding a predetermined level, to reduce the pressure of the hydraulic fluid passing to the associated ram.

8. A control system according to claim 4, wherein each pressure regulator is so constructed that hydraulic fluid can be passed to the associated ram at the full pressure of the pressure line.

9. A control system according to claim 8, wherein, when the system is to be used with double-acting rams, each pressure regulator is such that the full pressure of the pressure line can be applied to the opposite end of the associated ram to the end at which pressure is applied to regulate the thrust in dependence upon the loading of the winning machine drive.

10. A control system according to claim 1, wherein said pressure regulator means comprises a single pressure regulator.

11. A control system according to claim 10, wherein the pressure regulator communicates both with a pair of lines constituting hydraulic pressure and return lines and with a pair of lines constituting hydraulic supply lines to the rams.

12. A control system according to claim 11, wherein the pressure regulator is constituted by a pressure reducing valve, control valve means for directing the hydraulic fluid leaving the pressure reducing valve to a first of the supply lines when in a first operating condition and to the second of the supply lines when in a second operating condition, and switching means for switching the control valve means between its two conditions.

13. A control system according to claim 12, wherein the pressure reducing valve is adjustable.

14. A control system according to claim 13, wherein the range of adjustment of the pressure reducing valve is from 20 to 300 $kg/cm^2$.

15. A control system according to claim 12, wherein the control valve means is constituted by two pairs of interconnected, hydraulically operated, non-return valves, the hydraulic line connecting one of said pairs of non-return valves being connected to the outlet of the pressure reducing valve, and the hydraulic line connecting the other of said pairs of non-return valves being connected to the return line, and wherein one non-return valve of each pair is connected to the first supply line and the other non-return valve of each pair is connected to the second supply line.

16. A control system according to claim 15, wherein a check valve is provided in the hydraulic line connecting the outlet of the pressure reducing valve and said one of said pairs of non-return valves, and a check valve is provided in the hydraulic line connecting the return line to said other of said pairs of non-return valves.

17. A control system according to claim 16, wherein each of the check valves is manually operable.

18. A control system according to claim 15, wherein the switching means is constituted by a pair of hydraulic switching valves each of which is connected both to the pressure and return lines and to a respective one of said pairs of non-return valves, each of the hydraulic switching valves being controlled by said control signals.

19. A control system according to claim 11, wherein the control means is further provided with a respective auxiliary control unit for each of the rams, each auxiliary control unit being connected to both supply lines, and, in use, to both ends of the corresponding double-acting ram.

20. A control system according to claim 19, wherein each auxiliary control unit is so constructed as to be controlled either automatically by the pressure regulator, or manually.

21. A control system according to claim 19, wherein each auxiliary control unit has a first set of valves for automatic control and a second set of valves for manual control, the valves of both sets being cam-operated by a common valve spool, and wherein the inlets of the corresponding valves of the two sets are connected by bridging lines which incorporate non-return valves so positioned that when the valve spool is positioned for automatic control the bridging lines used during manual control are blocked and vice-versa.

22. A mining installation comprising a longwall conveyor, a winning machine movable along a guide provided on the conveyor, a drive unit for moving the winning machine along the guide, hydraulic shifting rams for the conveyor, and a control system for controlling the thrust applied by the rams to the conveyor, wherein the control system includes control means which regulates the thrust applied to the guide by the hydraylic rams in dependence upon the loading of the drive unit, said control means comprising a transducer for detecting the loading of the winning machine drive and for emitting appropriate control signals, and pressure regulators associated with the rams for regulating the thrust applied to the guide by said rams in dependence upon said control signals.

23. A mining installation according to claim 22, further comprising a roof support assembly which forms an abutment for the hydraulic rams.

24. A mining installation according to claim 23, wherein the roof support assembly is of the walking frame type.

25. A mineral mining installation comprising a longwall conveyor, a winning machine movable along a guide provided on the conveyor, a drive unit for moving the winning machine along the guide, hydraulic shifting rams for the conveyor, and a control system for controlling the thrust applied by the hydraulic rams to the conveyor, the control system including control means which regulates the thrust applied to the guide by the hydraulic rams in dependence upon the loading of the drive unit, wherein the control means is constituted by a transducer for detecting the loading of the drive unit and for emitting appropriate control signals, and by a respective pressure regulator associated with each of the hydraulic rams for regulating the thrust applied to the guide by said rams in dependence upon said control signals, each pressure regulator being provided with pressure reducing valve means constituted by a first valve which passes hydraulic fluid to the associated ram at a first, higher pressure when the winning machine drive is turned off, and at a second, lower pressure when the winning machine drive is turned on and the winning machine is working, and by a second valve which is operative, upon the loading of the drive unit exceeding a predetermined level, to reduce the pressure of the hydraulic fluid passing to the associated ram.

26. A mineral mining installation comprising a longwall conveyor, a winning machine movable along a guide provided on the conveyor, a drive unit for moving the winning machine along the guide, hydraulic shifting rams for the conveyor, and a control system for controlling the thrust applied by the hydraulic rams to the conveyor, the control system including control means which regulates the thrust applied to the guide by the hydraulic rams in dependence upon the loading of the drive unit, wherein the control means is constituted by a transducer for detecting the loading of the drive unit and for emitting appropriate control signals, and by a single pressure regulator for regulating the thrust applied to the guide by all the said rams in dependence upon said control signals, the pressure regulator communicating both with a pair of lines constituting hydraulic pressure and return lines and with a pair of lines constituting hydraulic supply lines to the rams, wherein the pressure regulator is constituted by a pressure reducing valve, control valve means for directing the hydraulic fluid leaving the pressure reducing valve to a first of the supply lines when in a first operating condition and to the second of the supply lines when in a second operating condition, and switching means for switching the control valve means between its two conditions.

27. A mineral mining installation according to claim 26, wherein the control valve means is constituted by two pairs of interconnected, hydraulically operated, non-return valves, the hydraulic line connecting one of said pairs of non-return valves being connected to the outlet of the pressure reducing valve, and the hydraulic line connecting the other of said pairs of non-return valves being connected to the return line, and wherein one non-return valve of each pair is connected to the first supply line and the other non-return valve of each pair is connected to the second supply line.

28. A mineral mining installation according to claim 26, wherein the switching means is constituted by a pair of hydraulic switching valves each of which is connected both to the pressure and return lines and to a respective one of said pairs of non-return valves, each of the hydraulic switching valves being controlled by said control signals.

29. A method of controlling the thrust applied to a mining winning machine which is movable, by means of a drive unit, along a guide at a longwall face in a mine working, the method comprising the steps of sensing the load of the drive unit, transmitting a control signal in dependence upon the sensed load, and controlling the thrust applied by hydraulic rams to the guide in dependence upon the control signal, a transducer being used to sense the load of the drive unit and transmit said control signal, and pressure regulators associated with the rams being used to regulate the thrust applied by the rams in dependence upon said control signal.

30. A method according to claim 29, wherein the thrust applied is controlled continuously.

31. A method according to claim 29, wherein the thrust applied is controlled in stages.

32. A method according to claim 29, wherein the thrust applied is reduced when the load on the winning machine drive exceeds a predetermined level.

33. A control system according to claim 1, wherein a respective pressure regulator is associated with all the rams of each of a plurality of groups of rams.

* * * * *